US005970547A

United States Patent [19]

Cavazos

[11] Patent Number: 5,970,547

[45] Date of Patent: Oct. 26, 1999

[54] MODULAR MATTRESS AND INNERSPRING

[76] Inventor: Frank G. Cavazos, 14040 Shoshoni Dr., Lockport, Ill. 60441

[21] Appl. No.: 08/835,184

[22] Filed: Apr. 7, 1997

[51] Int. Cl.[6] ..... A47C 27/14

[52] U.S. Cl. ..... 5/690; 5/723; 5/722; 5/738

[58] Field of Search ..... 5/640, 645, 723, 5/729, 722, 738, 719, 690

[56] References Cited

U.S. PATENT DOCUMENTS

| | | | |
|---|---|---|---|
| 787,450 | 4/1905 | Jacobs | 5/722 |
| 1,228,213 | 5/1917 | Hunt | 5/722 |
| 1,295,770 | 2/1919 | Lamont | 5/722 |
| 1,356,148 | 10/1920 | Hobert | 5/722 |
| 1,528,066 | 3/1925 | McEntire | 5/722 |
| 3,890,658 | 6/1975 | Petersilie | 5/722 |
| 4,969,223 | 11/1990 | Yamaguchi | 5/738 |
| 5,035,014 | 7/1991 | Blanchard | 5/739 |
| 5,065,485 | 11/1991 | Zocco | 5/738 |

*Primary Examiner*—Michael F. Trettel

*Assistant Examiner*—Fredrick Conley

*Attorney, Agent, or Firm*—Ernest Kettelson

[57] ABSTRACT

A modular mattress having a plurality of innerspring modules with a peripheral border strip extending around the periphery between the top mattress cover and the bottom mattress over. The border strip is connected to one or the other of the top or bottom mattress covers by sewing, and to the other by releasable connecting means such as a zipper. A fabric flange extends from the peripheral edge of both the top and bottom mattress covers, with a Velcro strip or the like along the free edge of each fabric flange. Each innerspring module has a side wall strip of material along its outwardly facing side wall with an upwardly extending flap having a cooperative Velcro strip along its free edge to releasably connect to the Velcro strip on the fabric flange of the top mattress cover, and a downwardly extending flap having a cooperative Velcro strip along its free edge to releasably connect to the Velcro strip on the fabric flange of the bottom mattress cover. The zippered edge of the peripheral border strip is zipped up to releasably connect it to the mattress cover having the corresponding zippered edge.

12 Claims, 5 Drawing Sheets

MODULAR MATTRESS AND INNERSPRING

RELATED APPLICATIONS

The inventor herein is also the inventor in co-pending U.S. patent application Ser. No. 08/533,032 filed Sep. 25, 1995 for a Mattress Having Access to Materials Sandwiched Between Mattress Cover and Inner Cushioning Assembly.

BACKGROUND OF THE INVENTION

This invention relates to the field of mattresses and innersprings, particularly to a modular mattress and modular innerspring, which is made up of a plurality of modules held together in side by side relationship by a retainer which extends around the periphery of the modular mattress and modular innerspring. The individual modules may be of whatever size and number needed to make a twin, twin extra long, full, full extra long, queen and king size mattress or innerspring.

PRIOR ART

Relevant prior art of which the inventor is aware is set forth in the following patents discovered during his searches for prior art.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,459,540 discloses a sectional mattress comprising three separate sections that are laid end to end to make up a complete mattress and can be interchanged in their relationship to each other. The innersprings within each section are encased in bags.

The inventor's own U.S. Pat. No. 5,435,026 discloses a do-it-yourself type of mattress which can be put together by the customer after purchasing the necessary component parts.

The inventor's own U.S. Pat. No. 5,471,688 discloses a modular innerspring assembly for a mattress and a modular box spring assembly on which the mattress is placed.

The inventor's own U.S. Pat. No. 5,485,639 discloses an S-shaped metal connecting clip having a spring characteristic to more easily connect the border wire around the top and bottom of an innerspring assembly to the top and bottom coils of adjacent coil springs.

In addition to the prior art found by the inventor's own searches, the following prior art has been cited by the Patent and Trademark Office in connection with other patent applications for somewhat related inventions:

| U.S. Patent Documents | | | |
|---|---|---|---|
| | Date | | |
| U.S. Pat. No. | Month | Year | Inventor |
| 163,131 | May | 1875 | Alvord |
| 272,076 | Feb. | 1883 | Mueller |
| 428,637 | May | 1890 | Schmitt |
| 757,420 | April | 1904 | Smith |
| 825,391 | July | 1906 | Horton |
| 871,244 | Nov. | 1907 | Smith |
| 879,232 | Feb. | 1908 | Young |
| 1,185,575 | May | 1916 | Anthony |
| 1,343,620 | June | 1920 | Gainer |
| 1,497,710 | June | 1924 | Cole |
| 1,618,852 | Feb. | 1927 | Tiffany |
| 1,725,356 | Aug. | 1929 | Kiwi |
| 1,746,942 | Feb. | 1930 | Hise |
| 2,086,767 | July | 1937 | Haas |
| 2,180,500 | Nov. | 1939 | Bernstein |
| 2,567,550 | Sept. | 1951 | Clark |
| 2,639,764 | May | 1953 | Fernberg |
| 3,176,325 | April | 1965 | Levine |
| 3,293,670 | Dec. | 1966 | Anson |
| 4,055,337 | Oct. | 1977 | Laiche |
| 4,402,097 | Sept. | 1983 | Scott |
| 4,956,884 | Sept. | 1990 | Hwang |
| 5,144,706 | Sept. | 1992 | Walker |

| Foreign Patent Documents | | | |
|---|---|---|---|
| | Date | | |
| Patent No. | Month | Year | Country |
| 188399 | Sept. | 1907 | Austria |
| 609691 | April | 1925 | France |
| 806711 | June | 1951 | Germany |

SUMMARY OF THE INVENTION

The present invention constitutes an improvement over the prior art in that a plurality of mattress or innerspring modules can be assembled to make up a modular mattress or innerspring of any desired size and held in place by an elongated retaining member or assembly around the periphery thereof.

In one embodiment, a retaining band has a width corresponding to the peripheral side wall dimension of the mattress or innerspring modules which make up the completed modular assembly. The retaining band is preferably elastic, and includes Velcro type fastening panels or strips at each opposite end, or a buckle assembly or the like to enable drawing the retaining band up tight and then holding it in such position until it is desired to release the retaining band for purposes of removing one or more modules and replacing with another.

The retaining band can also be a continuous length of material, preferably elastic, and slipped over the side by side modules when compressed together by a compression machine enough for the continuous band to be put in place. The compression machine then releases the modules from their compressed side by side and end to end position whereupon they expand to bear tightly against the peripheral retaining band.

By providing a retaining band with a width as great as the peripheral side wall of the modules, uniform pressure is thereby applied to all surface areas of the module side walls. Such uniform pressure is applied by the peripheral retaining band in the direction which urges each of the side by side and end to end modules toward each other. By providing a structure which supplies that pressure uniformly over the entire surface areas of the module side walls, the tendency of the modules to buckle is lessened and substantially eliminated and the stability of the modular assembly is substantially improved.

Spacing strips of urethane foam or the like are provided between the adjacent modules. Such spacing strips are slightly compressible when the peripheral retaining band is tightened around the side by side and end to end modules, and help to retain the standard dimensional width and length of the various size mattresses and innersprings which can be made by the modular assembly in accordance with this invention, when the peripheral retaining band is drawn up tight and secured.

The modules in accordance with this invention may be of any convenient size, so that when assembled in side by side and end to end relationship, they will make up any of the standard size mattresses and innersprings desired.

The mattress modules may be of the traditional mattress construction, having an innerspring assembly, cushioning material over the upper and lower surfaces of the innerspring assembly, a mattress cover over such cushioning materials on both surfaces, and a peripherally extending border around the side wall between the mattress cover over the upper surface and the mattress cover over the lower surface.

The peripheral retaining band in accordance with this invention can also be used as described to hold innerspring modules by themselves in place, with spacing strips placed between side by side and end to end innerspring modules, in the same manner as for the mattress modules.

In another embodiment of the invention, a modular mattress comprises a top and bottom mattress cover, each having a fabric flange extending from and around its peripheral edge with a strip of Velcro type fastening elements (tiny hooks or loops) extending around the peripheral free edge of each fabric flange. A plurality of inner spring mattress modules are enclosed between the mattress covers, each having a strip of material along its outer edge from which an upwardly extending flap having corresponding Velcro type fastening elements extends to releasably fasten to the strip of Velcro type fastening elements on the flange of the top mattress cover, and a downwardly extending flap having corresponding Velcro type fastening elements extends to releasably fasten to the strip of Velcro type fastening elements on the flange of the bottom mattress cover.

Before the mattress module strips are releasably fastened to the fabric flanges of the top and bottom mattress covers, layers of insulating material and cushioning material are placed over the upwardly and downwardly facing surfaces of the mattress modules and under the respective top and bottom mattress covers.

After the mattress module strips and flanges of the top and bottom mattress covers have been releasably secured together by the Velcro type fastening elements, a peripheral border strip secured to the peripheral edge of one mattress cover is connected by a zipper assembly to the other mattress cover, thereby covering the peripheral side wall of the modular mattress and the mattress modules held therein.

DESCRIPTION OF PREFERRED EMBODIMENTS

Figure 1:
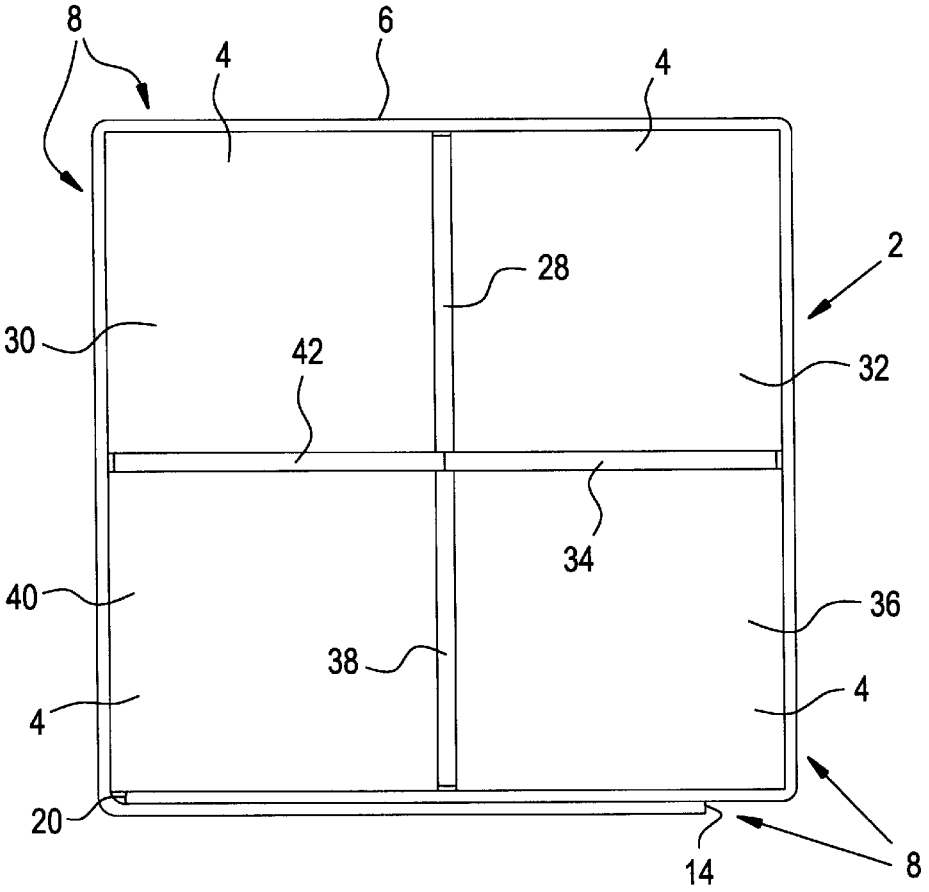
FIG. 1 is a top plan view of a modular mattress in accordance with this invention.
Figure 2:
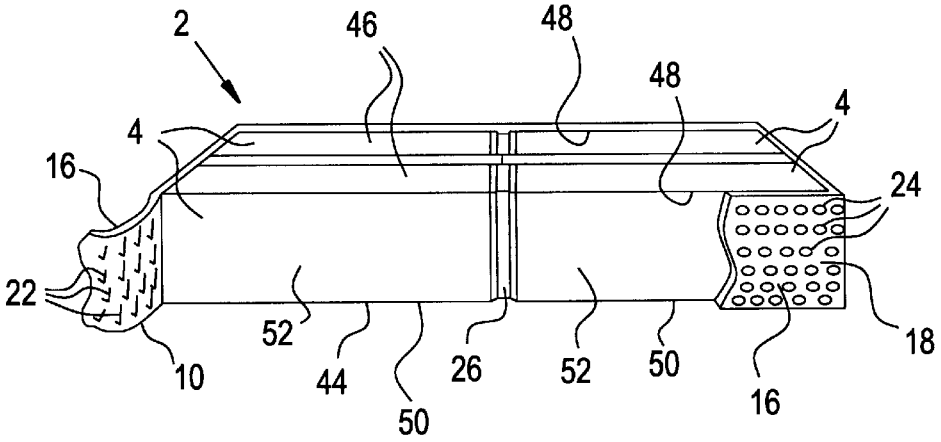
FIG. 2 is a perspective view of the modular mattress shown in FIG. 1 in which the peripheral retaining band is shown in its unconnected position and with end portions broken away to illustrate the releasable securing members which hold the peripheral retaining band together when its respective ends are connected.

A modular mattress 2 in accordance with the present invention comprises four or more separate mattress modules 4 which can be of different sizes, held together by an elongated retaining band 6 that extends around the entire periphery 8 of the modular mattress.

The inner surface 10 of the retaining band 6 has a first removably connecting panel 12 secured thereto at its first end 14. The outer surface 16 of the retaining band has a second removably connecting panel 18 secured thereto at the second end 20 of the elongated retaining band 6. The connecting panel 12 includes a plurality of tiny hook shaped projections 22 extending therefrom of the Velcro type, which interengage with a corresponding plurality of tiny loop members 24 of the corresponding Velcro type, projecting outward from the second connecting panel 18, when the two connecting panels are brought together.

The elongated retaining band 6 is preferably made of an elastic stretchable material, such as rubber or interwoven fabric encased lengths of stretchable material. However, the retaining band 6 can also be made of flexible non-stretchable material, as long as it can be drawn up tight around the periphery of the modular mattress 2 to hold the plurality of modules 4 in place next to adjacent modules.

Relatively narrow or thin spacing members 26 of urethane foam or the like may be provided and placed between adjacent modules to space them apart a uniform but relatively close distance when the retaining band 6 has been drawn tight around the periphery of the modular mattress 2 to hold the mattress modules 4 in place. Spacing member 28 is provided for placement between mattress modules 30 and 32. Spacing member 34 is provided for placement between mattress modules 32 and 36. Spacing member 38 is provided for placement between mattress modules 36 and 40, and spacing member 42 is provided for placement between mattress modules 40 and 30.

The spacing members 26 have a length corresponding to the lineal dimension of the side of the mattress module they are to be placed adjacent to. The spacing members 26 have a width corresponding to the thickness of the mattress module they are to be placed adjacent to, that is the dimension or distance between the downwardly facing surface 44 of each mattress module 4 and its upwardly facing surface 46.

The elongated retaining band 6 also has a width corresponding to the thickness, or spaced apart dimension or distance of the upwardly facing and downwardly facing surfaces, of each mattress module 4. Thus, when the retaining band 6 is drawn up tight around the periphery 8 of the modular mattress 2, the retaining band 6 applies uniform pressure against all facing portions of each mattress module in a direction toward each corresponding adjacent mattress module, from the upper peripheral border edge 48 down to the lower peripheral border edge 50. Such uniform pressure along all portions of the peripheral side wall 52 of the modular mattress 2 helps to prevent the adjacent mattress modules 4 from buckling, and helps to hold them in place thereby forming a modular mattress 2 which has comparable stability to a unitary mattress when the elongated retaining band 6 is drawn up tight and its ends secured together.

When it is desired to change one or more of the mattress modules 4, or to disassemble the modular mattress 2 for any reason, the ends of the elongated retaining band 6 are separated or loosened enough for the mattress modules to be removed. Worn mattress modules can be replaced with new, and the modular mattress then re-assembled by drawing the elongated retaining band 6 up tight around the periphery 8 of the mattress modules in side by side and end to end relationship, and securing the ends of the retaining band 6 together.

The description set forth above for mattress modules held in place by the peripheral retaining band in accordance with this invention applies also to innerspring modules used to create a modular innerspring of any desired standard size, such as twin, full, queen and king in both standard and extra long versions.

Figure 3:
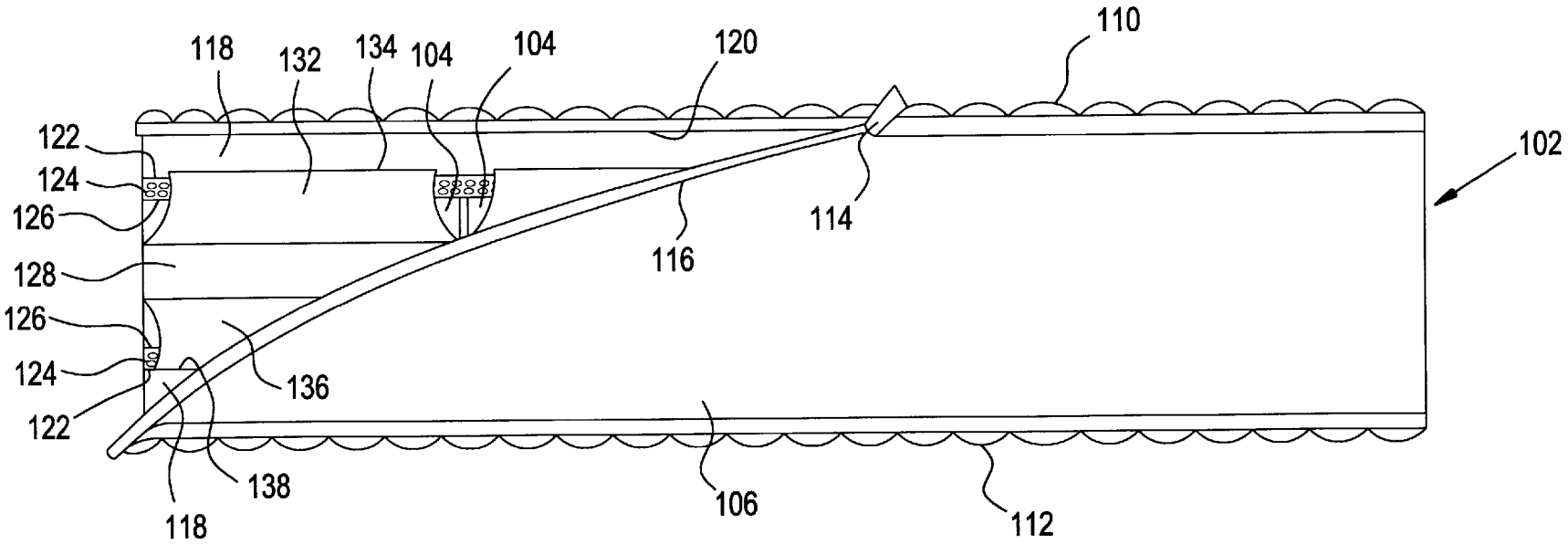
FIG. 3 is a side elevation view of a modular mattress assembly in accordance with another preferred embodiment of the invention.
Figure 4:
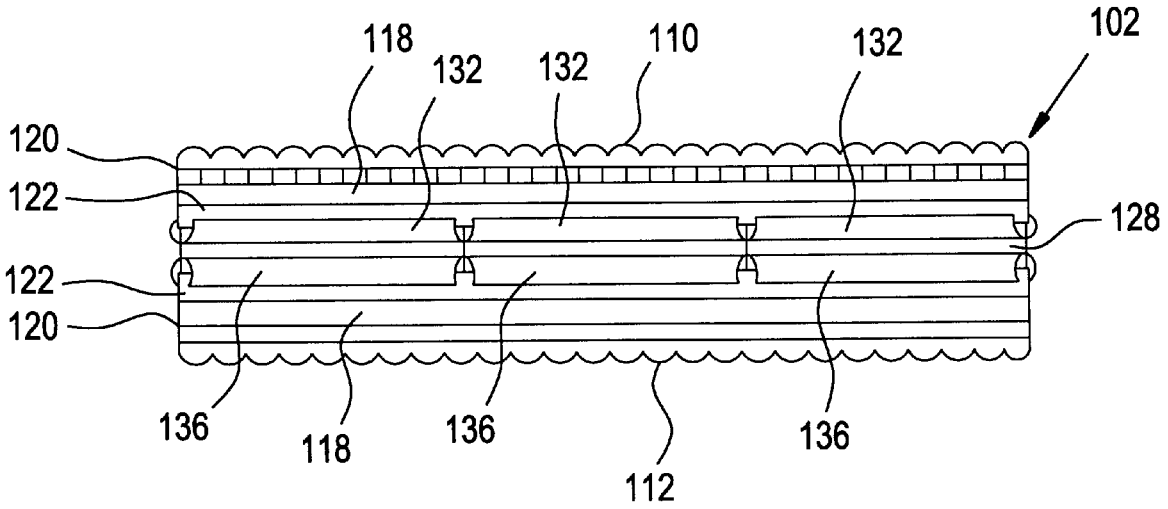
FIG. 4 is a side elevation view of a modular mattress assembly as shown in FIG. 3 but with its border strip removed to better illustrate internal portions of the assembly.
Figure 5:
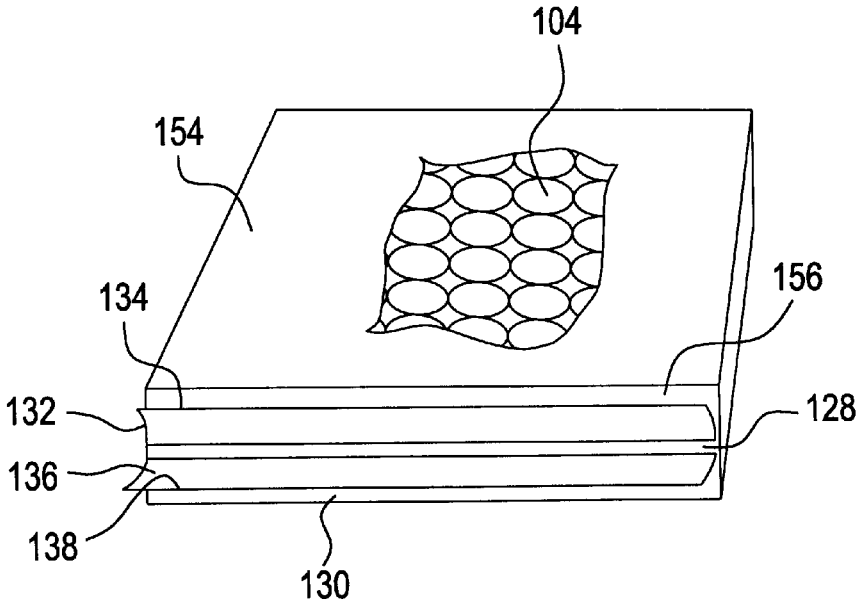
FIG. 5 is a perspective view of an innerspring module of the type that make up the modular mattress as shown in FIGS. 3 and 4 when a plurality of such modules are arranged in side by side relationship therein; the innerspring module is shown received in a fabric enclosure, a portion of which is shown broken away to show the coils of the innerspring module.
Figure 6:
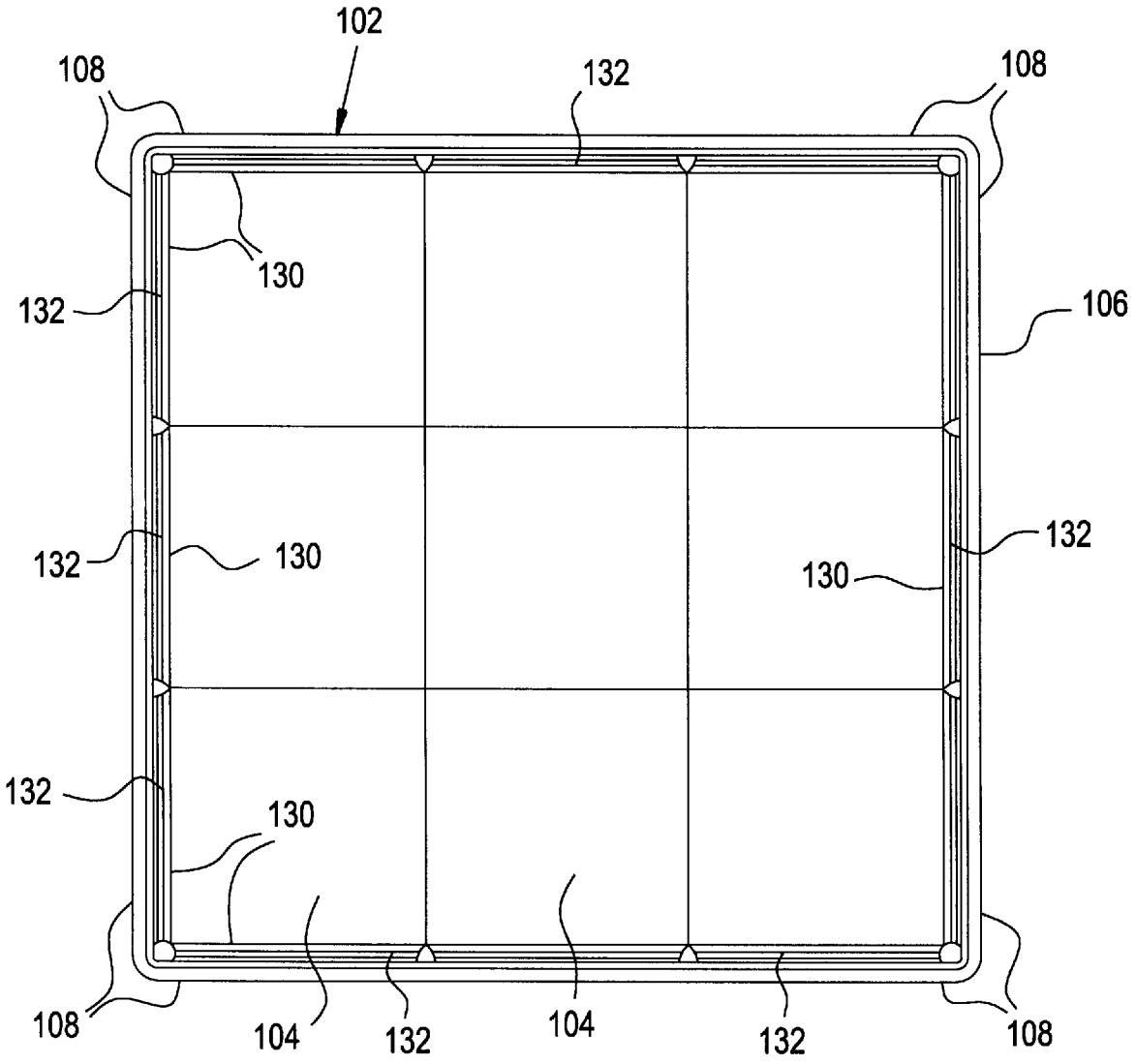
FIG. 6 is a top plan view of a modular mattress assembly as shown in FIGS. 3 and 4, but with the top mattress cover and layers of cushioning and insulating material removed to illustrate the innerspring modules within their fabric enclosures arranged and held in side by side relationship.
Figure 7:
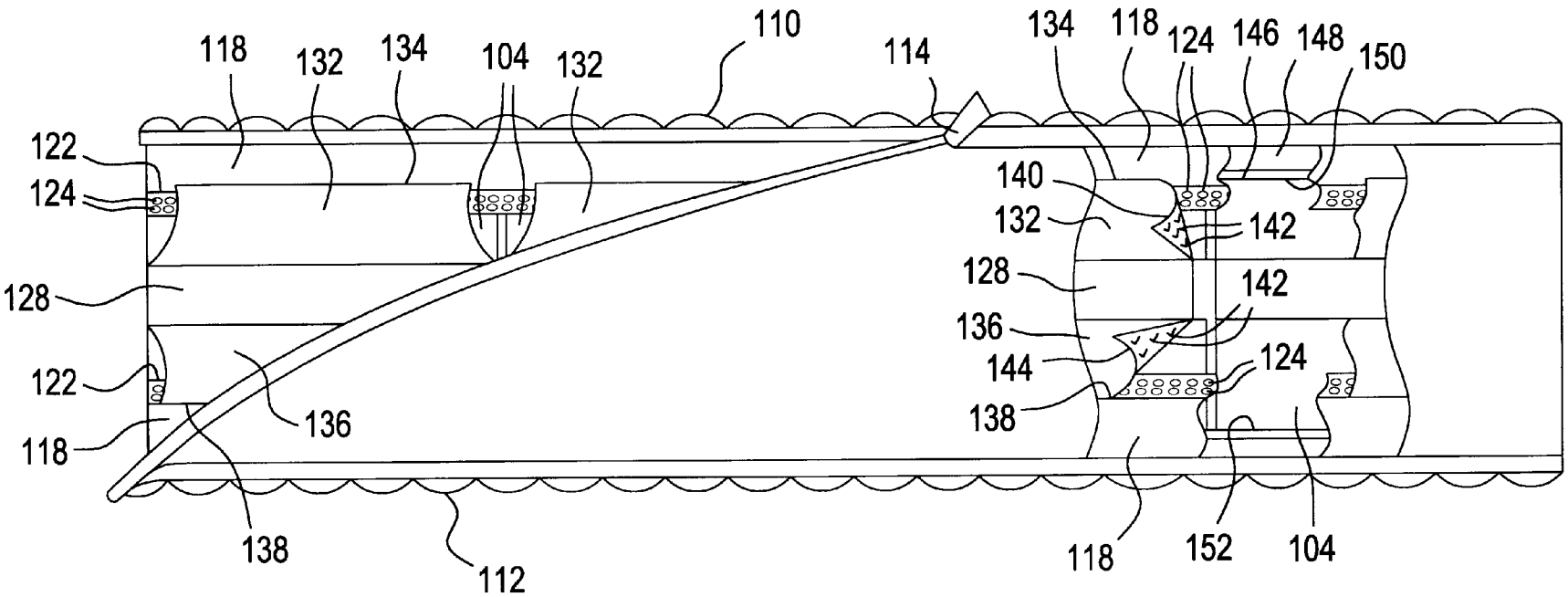
FIG. 7 is a side elevation view of a modular mattress assembly as shown in FIG. 3, but with a portion of the border strip broken away, a portion of the upper and lower flaps of the cooperative releasable connecting portion of the fabric innerspring enclosure also broken away, and a portion of the fabric flange of the top and bottom mattress covers also broken away to better illustrate interior portions of the modular mattress assembly.

A preferred embodiment of this invention as shown in FIG. 3, comprises a modular mattress 102, having a plurality of innerspring mattress modules 104, a peripheral border strip 106 extending around the entire periphery 108 of the mattress between a top mattress cover 110 and a bottom mattress cover 112. The border strip 106 is connected to one or the other of the top or bottom mattress covers by sewing, and releasably connectable to the other by a zipper assembly 114 which extends around the entire periphery of the mattress cover to which it is secured, and around the entire periphery of the edge 116 of border strip 106 adjacent to such mattress cover.

Each mattress cover includes a fabric flange 118 extending from its peripheral edge 120 around the entire periphery thereof. A cooperative fastening strip 122 of Velcro type fastening elements, such as tiny loops 124, extends along the free edge 126 of each fabric flange 118 around the entire periphery thereof.

Each innerspring mattress module 104 has a side wall strip of material 128 along its outwardly facing side wall 130, having an upwardly extending flap 132 that extends upwardly to terminate in a free edge 134 adjacent the free edge 126 of fabric flange 118 of the top mattress cover 110, and a downwardly extending flap 136 that extends downwardly to terminate in a free edge 138 adjacent the free edge 126 of fabric flange 118 of the bottom mattress cover 112.

A cooperative fastening strip 140 of Velcro type fastening elements, such as tiny hooks 142, extends along the free edge 134 of the upwardly extending flap 132, to releasably fasten such upwardly extending flap 132 of each mattress module 104 to the peripherally extending fabric flange 118 of the top mattress cover 110.

A cooperative fastening strip 144 of Velcro type fastening elements, such as tiny hooks 142, extends along the free edge 138 of the downwardly extending flap 136, to releasably fasten such downwardly extending flap 136 of each mattress module 104 to the peripherally extending fabric flange 118 of the bottom mattress cover 112.

Before the flaps of the mattress modules 104 are secured to the flanges 118 of the mattress covers, a layer of insulating material 146 and a layer of cushioning material 148 are placed over the upwardly facing surface 150 and downwardly facing surface 152 of the mattress modules 104, and under the top mattress cover 110 over the upwardly facing surface 150 of the modules 104, under the bottom mattress cover 112 over the downwardly facing surface 152 of the mattress modules 104.

When the insulating and cushioning materials are in place between the mattress covers and the mattress modules, and the flaps 132 and 136 along the outer side walls 130 of the mattress modules 104 have been releasably secured to the fabric flanges 118 of the top mattress cover 110 and of the bottom mattress cover 112 by the Velcro type fastening elements, the border strip 106 permanently secured to one mattress cover by sewing is then releasably secured to the other mattress cover by zipping up the zipper assembly 114 around the entire periphery of the modular mattress 102.

In the embodiment shown and described herein, the innerspring modules 102 are enclosed within a fabric bag or enclosure 154. The side wall strip of material 128 having the upwardly extending flap 132 and downwardly extending flap 136 for releasable connection to the fabric flanges of the top and bottom mattress covers is connected to the fabric enclosure 154 along the side 156 which borders the outwardly facing side wall 130 of the innerspring module 104 therein.

The side wall strip of material 128, and the flaps 132 and 136 which are releasably connectable to the fabric flanges of the top and bottom mattress covers respectively, can be secured to the innerspring modules 104 along their outwardly facing side walls 130 in other ways. It is not necessary to have the innerspring modules 102 enclosed in a fabric bag in which the side wall strip of material 128 is connected to or made a part of such bag. For example, a panel could be secured to the outwardly facing side wall 130 of the innerspring module 102, and the flaps 132 and 136 which extend upwardly and downwardly could then be secured to or integrally formed with such panel.

I claim:

1. A modular mattress assembly comprising a plurality of mattress modules, including a first mattress module having a first side wall and a first end wall, a second mattress module having a second side wall and a second end wall, said first side wall of said first mattress module and said second side wall of said second mattress module facing toward each other, said first mattress module having a first outwardly facing side wall facing oppositely from said first side wall and a first outwardly facing end wall facing oppositely from said first end wall, said second mattress module having a second outwardly facing side wall facing oppositely from said second side wall and a second outwardly facing end wall facing oppositely from said second end wall, said side and end walls of said mattress modules each having an upper peripheral edge and a lower peripheral edge, and retaining means extending around the periphery of said modular mattress assembly in pressure bearing relationship against said first and second outwardly facing side walls and end walls to hold said plurality of mattress modules in place, said retaining means including an elongated retaining member of relatively thin cross-section having an inwardly facing bearing surface facing said outwardly facing side walls and end walls of said mattress modules, said elongated retaining member extending continuously around said modular mattress assembly having an elongated upper longitudinal edge, an elongated lower longitudinal edge, and an elongated longitudinal mid-region therebetween, said inwardly facing bearing surface of said elongated retaining member when in place facing said side walls and end walls of said mattress modules being otherwise unobstructed and smooth throughout, said first and second outwardly facing side walls and end walls of said mattress modules facing said inwardly facing bearing surface of said retaining member when in place being otherwise unobstructed and smooth throughout, said inwardly facing bearing surface of said retaining member extending upwardly from said longitudinal mid-region thereof to terminate at said upper longitudinal edge thereof at a point no higher than said upper peripheral edges of adjacent ones of said mattress modules when in place and extending downwardly from said longitudinal mid-region thereof a substantially equal distance to terminate at said lower longitudinal edge thereof at a point no lower than said lower peripheral edges of adjacent ones of said mattress modules when in place, said mattress modules each having continuously unobstructed, uncovered, smooth upwardly facing surfaces throughout extending laterally to said upper peripheral edges of said side and end walls thereof and continuously unobstructed, uncovered, smooth downwardly facing surfaces throughout extending laterally to said lower peripheral edges of said side and end walls thereof.

2. A modular mattress assembly as set forth in claim 1, including a third mattress module having a third side wall and a third end wall, a fourth mattress module having a fourth side wall and a fourth end wall, said third mattress module having a third outwardly facing side wall facing oppositely from said third side wall and a third outwardly facing end wall facing oppositely from said third end wall, said fourth mattress module having a fourth outwardly facing side wall facing oppositely from said fourth side wall and a fourth outwardly facing end wall facing oppositely from said fourth end wall, said third side wall of said third mattress module and said fourth side wall of said fourth mattress module facing toward each other, said first end wall of said first mattress module and said fourth end wall of said fourth mattress module facing toward each other, said second end wall of said second mattress module and said third end wall of said third mattress module facing toward each other, said retaining member being in bearing relationship against said third and fourth outwardly facing side wall and end walls to hold said plurality of mattress modules together.

3. A modular mattress assembly as set forth in claim 1, including a spacing member between said first side wall of said first mattress module and said second side wall of said second mattress module, said spacing member having a first free end facing toward a portion of said inwardly facing bearing surface of said retaining member and terminating short thereof.

4. A modular mattress assembly as set forth in claim 2, including a first spacing member between said first side wall of said first mattress module and said second side wall of said second mattress module, a second spacing member between said third side wall of said third mattress module and said fourth side wall of said fourth mattress module, a third spacing member between said second end wall of said second mattress module and said third end wall of said third mattress module, and a fourth spacing member between said first end wall of said first mattress module and said fourth end wall of said fourth mattress module, said first, second, third and fourth spacing members each having a respective first free end facing toward a portion of said inwardly facing bearing surface of said retaining member and terminating short thereof.

5. A modular mattress assembly as set forth in claim 1, wherein said elongated upper longitudinal edge of said retaining band extends adjacent said upper peripheral edge bordering said upwardly facing surface of said first and second mattress modules when in place around said modular mattress assembly, said elongated lower longitudinal edge of said retaining band extends adjacent said lower peripheral edge bordering said downwardly facing surface of said first and second mattress modules when in place around said modular mattress assembly.

6. A modular mattress assembly as set forth in claim 5, wherein said elongated retaining band is made of a flexible material.

7. A modular mattress assembly as set forth in claim 5, wherein said elongated retaining band is made of an elastic stretchable material.

8. A modular mattress assembly as set forth in claim 7, wherein said elastic stretchable material includes rubber.

9. A modular mattress assembly as set forth in claim 5, wherein said elongated retaining band includes a first end, a second end facing and releasably connectable to said first end when said retaining band is in place around the periphery of said modular mattress assembly.

10. A modular mattress assembly as set forth in claim 9, wherein said first end of said elongated retaining band includes first cooperative releasable connecting means, said second end of said elongated retaining band includes second cooperative releasable connecting means for releasably connecting said first and second ends of said elongated retaining band together.

11. A modular mattress assembly as set forth in claim 10 wherein one of said first and second cooperative releasable connecting means includes a panel having a plurality of tiny hook members projecting therefrom and the other a panel having a plurality of tiny loop members projecting therefrom for releasable interconnection with said plurality of tiny hook members, when said first and second ends of said elongated retaining band are brought together.

12. A modular mattress assembly comprising a top mattress cover, a bottom mattress cover, a top fabric flange extending downwardly from the peripheral edge of said top mattress cover, a bottom fabric flange extending from the peripheral edge of said bottom mattress cover, a plurality of mattress modules in side by side relationship between said top and bottom mattress covers and arranged to present an outwardly facing peripheral side wall around the periphery thereof, said mattress modules arranged to present said outwardly facing peripheral side wall each having an outwardly facing side wall, a side wall securing strip along each of said outwardly facing side walls, each of said side wall securing strips having an upwardly extending flap extending upwardly toward said top fabric flange of said top mattress cover and being releasably secured thereto, each of said side wall securing strips having a downwardly extending flap extending downwardly toward said bottom fabric flange of said bottom mattress cover and being releasably secured thereto, including releasable securing means to releasably secure said upwardly extending flap of said side wall securing strip of each of said mattress modules to said top fabric flange of said top mattress cover and said downwardly extending flap of said side wall securing strip of each of said mattress modules to said bottom fabric flange of said bottom mattress cover, wherein said releasable securing means includes tiny hook elements and tiny loop elements which are releasably securable to each other, wherein each of said mattress modules comprise an innerspring assembly, wherein said plurality of mattress modules include a first mattress module and a first innerspring assembly thereof, a first fabric enclosure, said first innerspring assembly being received in said first fabric enclosure, said side wall securing strip of each of said modules including a first side wall securing strip, said first side wall securing strip being secured to said first fabric enclosure along said outwardly facing side wall of said first mattress module and said first innerspring assembly thereof.

* * * * *